US007735460B2

(12) United States Patent
Hubberd

(10) Patent No.: US 7,735,460 B2
(45) Date of Patent: Jun. 15, 2010

(54) METHOD AND APPARATUS FOR OPERATING STANDARD GASOLINE-DRIVEN ENGINES WITH A READILY-AVAILABLE NON-VOLATILE FUEL, THEREBY OBVIATING THE USE OF GASOLINE

(75) Inventor: William A. Hubberd, Williamsburg, VA (US)

(73) Assignee: Leonard Bloom, Owings Mills, MD (US), part interest ( * ) Notice: Subject to any disclaimer, the term of this patent is extended or adjusted under 35 U.S.C. 154(b) by 0 days.

(21) Appl. No.: 12/229,520

(22) Filed: Aug. 22, 2008

(65) Prior Publication Data

US 2009/0194052 A1 Aug. 6, 2009

Related U.S. Application Data

(60) Provisional application No. 61/063,255, filed on Feb. 1, 2008, provisional application No. 61/135,489, filed on Jul. 21, 2008.

(51) Int. Cl.
*F02B 63/00* (2006.01)
*F02B 19/00* (2006.01)
*F02P 23/00* (2006.01)

(52) U.S. Cl. ..... 123/2; 123/143 B

(58) Field of Classification Search ..... 123/143 B, 123/2

See application file for complete search history.

(56) References Cited

U.S. PATENT DOCUMENTS

| | | | | |
|---|---|---|---|---|
| 931,389 | A | 8/1909 | Crook | |
| 1,064,086 | A | 6/1913 | Porter et al. | |
| 1,086,327 | A | 2/1914 | Kopf | |
| 1,105,016 | A | 7/1914 | Bassford | |
| 1,148,106 | A | 7/1915 | Lux | |
| 1,164,082 | A | 12/1915 | Gallant | |
| 1,202,610 | A | 10/1916 | Thornhill et at | |
| 1,218,545 | A | 3/1917 | Giddens | |
| 1,436,760 | A | 11/1922 | Gleason | |
| 1,448,651 | A | 3/1923 | Woolson | |
| 1,471,600 | A | 10/1923 | Hartsough | |
| 1,472,264 | A | 10/1923 | Beck | |
| 1,477,119 | A | 12/1923 | Graf | |
| 1,671,740 | A | 5/1928 | Phillips | |
| 1,718,569 | A | 6/1929 | Lonaberger et al | |
| 2,026,851 | A | 1/1936 | Slate | 123/133 |
| 2,028,333 | A | 1/1936 | Johnston et al. | 261/12 |
| 2,225,647 | A | 12/1940 | Liekendael | 48/107 |
| 2,306,897 | A | 12/1942 | Ollig | 48/107 |
| 2,323,639 | A | 7/1943 | Anderson | 123/127 |
| 2,376,362 | A | 5/1945 | Kasarjian | 313/85 |
| 2,516,754 | A | 7/1950 | Cipriani et al | 123/169 |

(Continued)

*Primary Examiner*—Stephen K Cronin
*Assistant Examiner*—David Hamaoui
(74) *Attorney, Agent, or Firm*—Hodes, Pessin & Kata, P.A.

(57) ABSTRACT

The conventional spark plug of a gasoline engine is removed and replaced with a high-power spark plug capable of delivering very high power (e.g., one megawatt) over a relatively-narrow time interval (e.g., 20 nanoseconds). Next, the gasoline is replaced with a readily-available non-volatile fuel (e.g., JP-8). The gasoline—and its transportation, storage, handling and/or use—is eliminated altogether, thereby removing a strategic and tactical threat from enemy and terrorist forces who otherwise would be targeting the gasoline tanks. Additionally, or alternatively, the fuel in the line (or the fuel injector) may be heated to start a cold engine or under cold ambient temperatures.

1 Claim, 1 Drawing Sheet

U.S. PATENT DOCUMENTS

| | | | | |
|---|---|---|---|---|
| 2,747,555 | A | 5/1956 | Brunner | 123/32 |
| 3,013,181 | A | 12/1961 | Marks et al | 315/58 |
| 3,561,413 | A | 2/1971 | Zurner | 123/122 |
| 3,667,436 | A | 6/1972 | Reichhelm | 123/119 A |
| 3,683,232 | A | 8/1972 | Baur | 315/58 |
| 4,395,998 | A | 8/1983 | Chou | 123/575 |
| 4,543,921 | A | 10/1985 | Torigai et al. | 123/73 A |
| 4,549,114 | A | 10/1985 | Herden | 315/58 |
| 4,570,605 | A | 2/1986 | Eberhardt | 123/576 |
| 4,613,789 | A | 9/1986 | Herden et al. | 315/58 |
| 4,636,690 | A | 1/1987 | Herden et al. | 315/58 |
| 4,746,834 | A | 5/1988 | Bäuerle et al. | 313/137 |
| 5,272,415 | A | 12/1993 | Griswold et al. | 315/58 |
| 5,371,436 | A | 12/1994 | Griswold et al. | 315/58 |
| 5,570,667 | A * | 11/1996 | Gray et al. | 123/179.21 |
| 5,681,358 | A | 10/1997 | Spencer et al. | 44/300 |
| 5,758,826 | A * | 6/1998 | Nines | 239/136 |
| 5,938,799 | A | 8/1999 | Spencer et al. | 44/300 |
| 6,110,237 | A | 8/2000 | Spencer et al. | 44/300 |
| 6,113,660 | A | 9/2000 | Hubbard et al. | 44/300 |
| 6,217,531 | B1 * | 4/2001 | Reitmajer | 601/4 |
| 6,334,418 | B1 * | 1/2002 | Hubbard | 123/179.21 |
| 6,676,402 | B1 * | 1/2004 | Early et al. | 431/1 |
| 2007/0188063 | A1 | 8/2007 | Lykowski | 313/137 |
| 2007/0262721 | A1 * | 11/2007 | Camilli | 315/32 |
| 2008/0018216 | A1 * | 1/2008 | Camilli | 313/141 |

* cited by examiner

METHOD AND APPARATUS FOR OPERATING STANDARD GASOLINE-DRIVEN ENGINES WITH A READILY-AVAILABLE NON-VOLATILE FUEL, THEREBY OBVIATING THE USE OF GASOLINE

CROSS REFERENCE TO RELATED APPLICATIONS

This non-provisional application is filed pursuant to two (2) respective provisional applications, Ser. No. 61/063,255 filed on Feb. 1, 2008 and Ser. No. 61/135,489 filed on Jul. 21, 2008, the disclosures and teachings of which are incorporated by reference herein.

FIELD OF THE INVENTION

The present invention relates to gasoline engines and, more particularly, to a method and apparatus for eliminating the gasoline and running the engine on other non-volatile fuels and, especially, fuels which are readily available.

BACKGROUND OF THE INVENTION

I am the (joint) inventor of a number of U.S. patents disclosing the method and composition of an emergency fuel in the event a motorist runs out of gas on the road. Various compositions were disclosed including, for example, a blend of aromatic and aliphatic mineral spirits (akin to paint thinners) and the resulting product was sold under the trademark "SPARE TANK". The applicable patents are as follows—

| No. | Issue Date |
|---|---|
| 5,681,358 | Oct. 27, 1997 |
| 5,853,433 | Dec. 29, 1998 |
| 5,938,799 | Aug. 17, 1999 |
| 6,110,237 | Aug. 29, 2000 |
| 6,113,660 | Sep. 5, 2000 |

—and their disclosures and teachings are incorporated by reference herein.

Since then, I have learned of an interesting development in the automotive industry, namely, a high-power spark plug marketed by Enerpulse, Incorporated of Albuquerque, N. Mex. under the trademark "PULSTAR". This product has been disclosed in the following published patent applications—

| | |
|---|---|
| US 2007/0262721 | Published 15 Nov. 2007 |
| US 2008/0018216 | Published 24 Jan. 2008 |

—the respective disclosures and teachings of which are incorporated by reference herein.

This "PULSTAR" spark plug is intended for automobiles and other vehicles and its purpose is to improve engine efficiency, acceleration power, and gas mileage in standard cars. Their marketing focus is the automobile aftermarket and, eventually, the O.E.M. market. All of their published research and development has been directed to gas-guzzling cars, and there has been no hint or suggestion that this product could be used—not with gasoline—but with non-volatile fuels for an entirely different purpose.

In a completely different "orbit", for many years the military has been concerned with the transport, storage, handling and use of gasoline for powering certain vehicles and other peripheral equipment using gasoline engines. It is a huge strategic and tactical problem.

For example, at the present time the United States Army brings in gasoline in tanker trucks from Kuwait to Baghdad in large convoys guarded by troops. These convoys of tanker trucks are very inviting targets for terrorists, insurgents and enemy forces. The Navy, on the other hand, uses certain types of equipment (powered by gasoline engines) in Naval shipyards and on the ships at sea, including carriers. To power this equipment, the carrier has a large tank or tanks to store the gasoline, and a direct hit on those tanks by a cruise missile or torpedo could completely disable the ship.

Although there is extensive research and development conducted by the military, including research and development on fuel cells, I am not aware of any instance where the military has found a way to completely eliminate the gasoline altogether, and to power typical gasoline engines with a substantially non-volatile fuel and, especially, a fuel that is readily available. Typical of such fuels are JP-4, JP-8 and Jet A1; presently, JP-8 is very heavily used.

Thus, to remove the strategic and tactical threat while simultaneously greatly simplifying the logistics, it would be very desirable to power the existing gasoline-driven engines by using a standard widely-used non-volatile fuel, such as JP-8, and to provide a relatively simple retrofit kit that can be implemented out in the field.

SUMMARY OF THE INVENTION

Accordingly, I bridged these two separate and distinct technologies. First, I realized that I could modify a standard gas engine by removing its conventional spark plug and substituting the special "PULSTAR" high-power spark plug (normally used for an altogether different purpose). Second, I could eliminate the gasoline and substitute a non-volatile fuel. So, I could achieve the best of both worlds. As a result, I could eliminate a serious strategic and tactical problem for the military and security forces; simplify their logistics by using a standard non-volatile fuel; start a cold engine or under cold ambient temperatures; and maintain the reliability of their gasoline-engine driven equipment.

In accordance with the teachings of the present invention, I have herein disclosed the method of operating a spark-fired gasoline engine in equipment such as that used by the military and/or security services, including the steps of replacing the conventional spark plug with a high-power spark plug capable of delivering a substantially high amount of power over a substantially narrow time interval, and replacing the gasoline with a readily-available substantially non-volatile jet fuel having a substantially-high flash point. The fuel is relatively safe to transport, store, handle and/or use, thereby greatly simplifying logistical problems while eliminating the necessity for transporting, storing, handling and/or using gasoline, and thereby eliminating an inviting target for enemy and/or terrorist forces. The fuel will be ignited by the high-power spark plug even though the engine and/or the ambient temperature is relatively cold.

In a preferred embodiment, the high-power spark plug delivers approximately 1 megawatt of power over approximately 20 nanoseconds.

Preferably, the fuel is selected from the group comprising JP-4, JP-8 and Jet A1 (and, preferably, JP-8).

In one embodiment, the high-power spark plug has a modified gap in the range of approximately 1/16 to 3/16 of an inch.

Viewed in another aspect, I have disclosed the combination of a spark-fired gasoline engine having one or more spark plugs which are capable of delivering a substantially-high amount of power over a substantially-narrow time interval, and a substantially non-volatile fuel having a substantially-high flashpoint. The fuel is relatively safe to transport, store, handle and/or use, thereby eliminating the necessity for transporting, storing, handling and/or using gasoline, and thereby eliminating an inviting target for enemy and/or terrorist forces. The fuel will be ignited by the spark plug even though the engine and/or the ambient temperature is relatively cold.

Moreover, to further assure reliability of the equipment (with or without the high-power "PULSTAR" plug) I can heat the fuel in the line just ahead of the fuel injection and/or include a heating coil or other heating element in the base of the injector—as disclosed and claimed in my U.S. Pat. No. 6,334,418 issued on Jan. 1, 2002, the disclosure and teachings of which are incorporated by reference herein.

Thus, I have assembled and bridged three readily-available technologies—

1) The "PULSTAR" high-powered spark plug intended to improve power, acceleration and gas mileage in automobiles and other vehicles;
2) The readily-available widely-used non-volatile fuels (e.g., JP-8); and
3) My own U.S. Pat. No. 6,334,418 for heating the fuel or the fuel injector.

—and as a result, I have solved a nagging long-standing strategic and tactical problem heretofore encountered, tolerated and guarded against by our military and security forces.

These and other objects of the present invention will become apparent from a reading of the following specification, taken in conjunction with the enclosed drawings.

GENERAL DESCRIPTION OF THE PREFERRED EMBODIMENT

Figure 1:
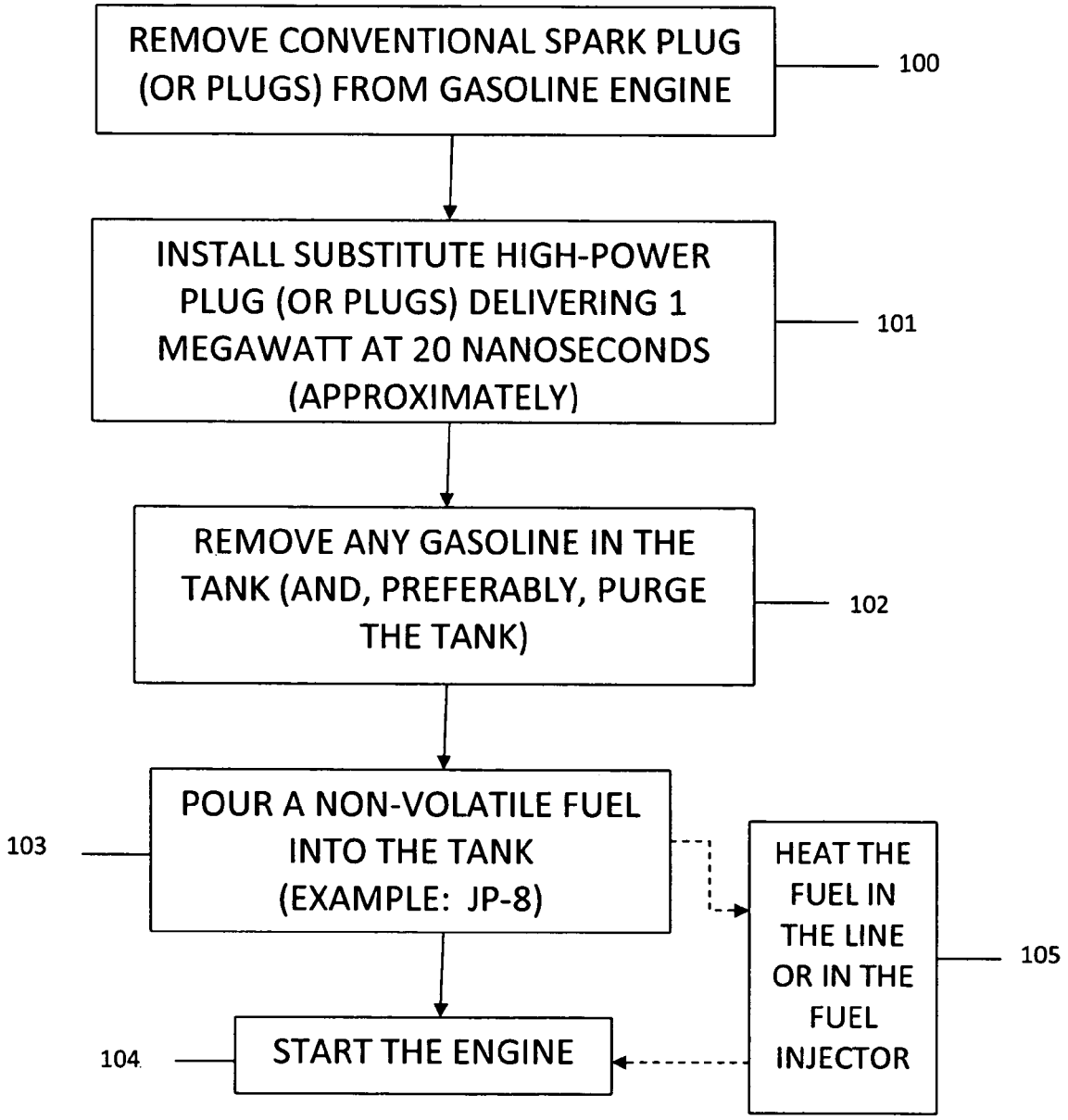
FIG. 1 is a method flow chart to implement the present invention.

With reference to FIG. 1, the existing spark plug (or plugs) in a gasoline-engine driven piece of equipment—such as that used by the military or security forces—is removed at Step 100—and replaced with a readily-available relatively high-power spark plug (at Step 101), such as the spark plug marketed under the trademark "PULSTAR" by Enerpulse, Incorporated located in Albuquerque, N. Mex. (or its equivalent). The "PULSTAR" plug claims output power of one megawatt at 20 nanoseconds.

In Step 102, the gasoline is drained or removed out of the gas tank and, preferably, the tank is purged of gasoline. A non-volatile fuel (e.g. JP-8 jet fuel) is poured into the tank (Step 103) and the engine is started (Step 104). If necessary or desirable, the fuel in the line may be heated or the fuel injector heated (Step 105) per my earlier patent, as disclosed hereinafter.

In a preliminary experiment, I retrofitted an existing gasoline lawn mower engine by substituting a "PULSTAR" plug for the mower's conventional plug and by filling the tank with my patented "SPARE TANK" fuel having a flashpoint of about 105° F.; and the (cold) engine fired up immediately.

In a later experiment, however, again with a cold engine and pouring Jet-A1 fuel—similar to JP-8—into the tank, the cold engine did not start immediately. So, I drained out the Jet-A1, poured in some gasoline, and started the engine to warm it up. Thereafter, the gasoline was used up and drained out and Jet-A1 was added to the tank; the warm engine fired up immediately and operated smoothly despite the relatively low octane number of the Jet-A1 fuel.

I then realized that my retrofit kit, if necessary or desirable, could include a heater for the fuel line between the fuel reservoir and the ignition chamber or a heating element in the fuel injector directly—basically a modified fuel injector as disclosed and taught in my U.S. Pat. No. 6,334,418—the disclosure and teachings of which are incorporated by reference herein. As disclosed therein, the heating is stopped after the engine warms up sufficiently.

The main thrust of my '418 patent was to facilitate the use of alternative fuel in automobiles, such as the use of my "SPARE TANK" fuel. Others in the industry have heated fuel injectors to reduce pollution during engine warm-up. Again, the purpose was environmental, and not to facilitate the use of JP-8 (or other standard jet fuels used by the military) so as to eliminate the gasoline for improved security.

Accordingly, I have discovered that by retrofitting the gasoline engines out in the field by using a "PULSTAR" plug (or its equivalent)—and/or by retrofitting the engine with a heated fuel injector—the military and/or security forces can use a readily-available widely-used non-volatile fuel, such as JP-8. I can thereby completely eliminate the strategic and tactical threat characterized by storage tanks of gasoline in our military and internal security installations and on board the aircraft carriers and other ships at sea. Moreover, the logistics are simplified by completely eliminating one of the supply lines (namely, the supply of gasoline). So there is an economic benefit commensurate with increased security.

Jet fuels, such as JP-8, have an inherently low octane number (around 30 or so) but, traditionally, octane ratings are not really significant for jet fuels. Conversely, petroleum researchers, automotive engineers, or the designers of various types of gasoline-engine driven equipment—and indeed the general public—would never think of using the jet fuels (such as JP-8) because of their inherently low octane ratings. They would all know that it wouldn't work. You can't do that. The engine would continue to knock and could literally shake itself to pieces.

I have discovered, however, that by using my invention—combining JP-8 with "PULSTAR" (or its respective equivalent)—the gasoline engine runs smoothly. It purrs like a kitten.

Of course, it will be understood that other non-volatile fuels may be used—one based on vegetable oils with possibly some additives—depending upon the economics and other factors and considerations.

Obviously, many modifications may be made without departing from the basic spirit of the present invention. Accordingly, and within the scope of the appended claims, the present invention may be practiced other than specifically disclosed herein.

What is claimed is:

1. A retrofit kit for a spark-fired gasoline engine out in the field, comprising one or more high-power spark plugs capable of delivering approximately 1 megawatt of power over approximately 20 nanoseconds, such that said high-power spark plugs may replace the conventional plugs in the engine, and a supply of substantially non-volatile fuel having a substantially high flashpoint and comprising mineral spirits and aromatics, such that said non-volatile fuel may be used to start a cold engine and run the engine, thereby eliminating the use of dangerous gasoline.

* * * * *

UNITED STATES PATENT AND TRADEMARK OFFICE

CERTIFICATE OF CORRECTION

PATENT NO. : 7,735,460 B2
APPLICATION NO. : 12/229520
DATED : June 15, 2010
INVENTOR(S) : William A. Hubbard It is certified that error appears in the above-identified patent and that said Letters Patent is hereby corrected as shown below:

Title Page; item (12) and (75);

The inventor's last name was misspelled (Hubberd). The correct spelling is (Hubbard).

Signed and Sealed this

Nineteenth Day of October, 2010

David J. Kappos

David J. Kappos
*Director of the United States Patent and Trademark Office*